US009927089B1

(12) United States Patent
Hsieh

(10) Patent No.: US 9,927,089 B1
(45) Date of Patent: Mar. 27, 2018

(54) LAMPSHADE

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 15/417,009

(22) Filed: Jan. 26, 2017

(51) Int. Cl.

| | |
|---|---|
| ***F21V 11/00*** | (2015.01) |
| ***F21V 1/14*** | (2006.01) |
| ***F21V 17/06*** | (2006.01) |
| ***F21V 1/04*** | (2006.01) |

(52) U.S. Cl.
CPC ..... *F21V 1/143* (2013.01); *F21V 1/04* (2013.01); *F21V 17/06* (2013.01)

(58) Field of Classification Search
CPC ... F21V 1/04; F21V 1/06; F21V 1/143; F21V 17/00; F21V 17/06; F21V 17/16
See application file for complete search history.

(56) References Cited

U.S. PATENT DOCUMENTS

| | | | | | |
|---|---|---|---|---|---|
| 4,625,268 | A * | 11/1986 | Payne | F21V 1/00 | 362/352 |
| 4,731,716 | A * | 3/1988 | Chang | F21V 1/06 | 362/352 |
| 4,772,992 | A * | 9/1988 | Tang | F21V 1/06 | 362/352 |
| 5,868,492 | A * | 2/1999 | Strickland | F21V 1/06 | 362/352 |
| 6,315,434 | B1 * | 11/2001 | Long | F21V 1/06 | 362/352 |
| 2003/0123256 | A1 * | 7/2003 | Lin | F21V 1/06 | 362/352 |

* cited by examiner

*Primary Examiner* — Ali Alavi
(74) *Attorney, Agent, or Firm* — Hamre, Schumann, Mueller & Larson, P.C.

(57) ABSTRACT

A lampshade includes a shade unit, and rigid upper and lower frames. The shade unit includes a flexible shade body, multiple upper fixing members each formed with an upper fixing hole, and multiple lower fixing members each formed with a lower fixing hole. The shade body defines a receiving space having opposite upper and lower openings. The upper and lower fixing members are disposed on the shade body and in the receiving space, and respectively adjacent to the upper and lower openings. The rigid upper frame includes multiple upper engaging members engaging respectively and detachably the upper fixing holes. The rigid lower frame includes multiple lower engaging members engaging respectively and detachably the lower engaging holes.

13 Claims, 10 Drawing Sheets

LAMPSHADE

FIELD

The disclosure relates to a lampshade, and more particularly to a lampshade that can be assembled or dissembled without using a tool.

BACKGROUND

Lamps are common home appliances used for illumination. Based on the purposes and applications, the lamps can be classified into different types, such as ceiling lamps, bracket lamps, floor lamps, table lamps, etc. The lamps may be provided with lampshades for achieving the functions of light diffusion, color changing, etc.

The lampshades can be either one piece or modular. One disadvantage associated with one piece lampshades resides in that it is troublesome or even difficult to be dissembled from the lamps and transport. Damages to the one piece lampshades may occur when transporting the same due to their large sizes, resulting in higher costs. As a result, modular lampshades are used widely. However, screw drivers are often needed for assembling and dissembling such lampshades. It is rather inconvenient for an user when there is no screw drivers at hand. Moreover, it may be inconvenient to align pieces of the lampshades and fasten the pieces by screws.

SUMMARY

Therefore, an object of the present disclosure is to provide a lampshade that can alleviate at least one of the drawbacks associated with the prior art.

According to the present disclosure, a lampshade includes a shade unit, a rigid upper frame and a rigid lower frame.

The shade unit includes a flexible shade body, a plurality of upper fixing members and a plurality of lower fixing members. The flexible shade body defines a receiving space that has an upper opening and a lower opening opposite to the upper opening. The upper fixing members are disposed on the flexible shade body and in the receiving space and adjacent to the upper opening. Each of the upper fixing members is formed with an upper fixing hole. The lower fixing members are disposed on the flexible shade body and in the receiving space and adjacent to the lower opening. Each of the lower fixing members is formed with a lower fixing hole.

The rigid upper frame is disposed in the receiving space and adjacent to the upper opening. The rigid upper frame includes an upper frame body, a plurality of upper engaging members and a base. The upper engaging members project outwardly from the upper frame body, and engage respectively and detachably the upper fixing holes of the upper fixing members. The base is connected to and projects inwardly from the upper frame body, and is adapted for a lamp to be mounted thereon.

The rigid lower frame is disposed in the receiving space and adjacent to the lower opening. The rigid lower frame includes a lower frame body and a plurality of lower engaging members. The lower engaging members project outwardly from the lower frame body and engage respectively and detachably the lower engaging holes of the lower fixing members.

BRIEF DESCRIPTION OF THE DRAWINGS

Other features and advantages of the present disclosure will become apparent in the following detailed description of the embodiment and variation with reference to the accompanying drawings, of which.

DETAILED DESCRIPTION

Figure 1:
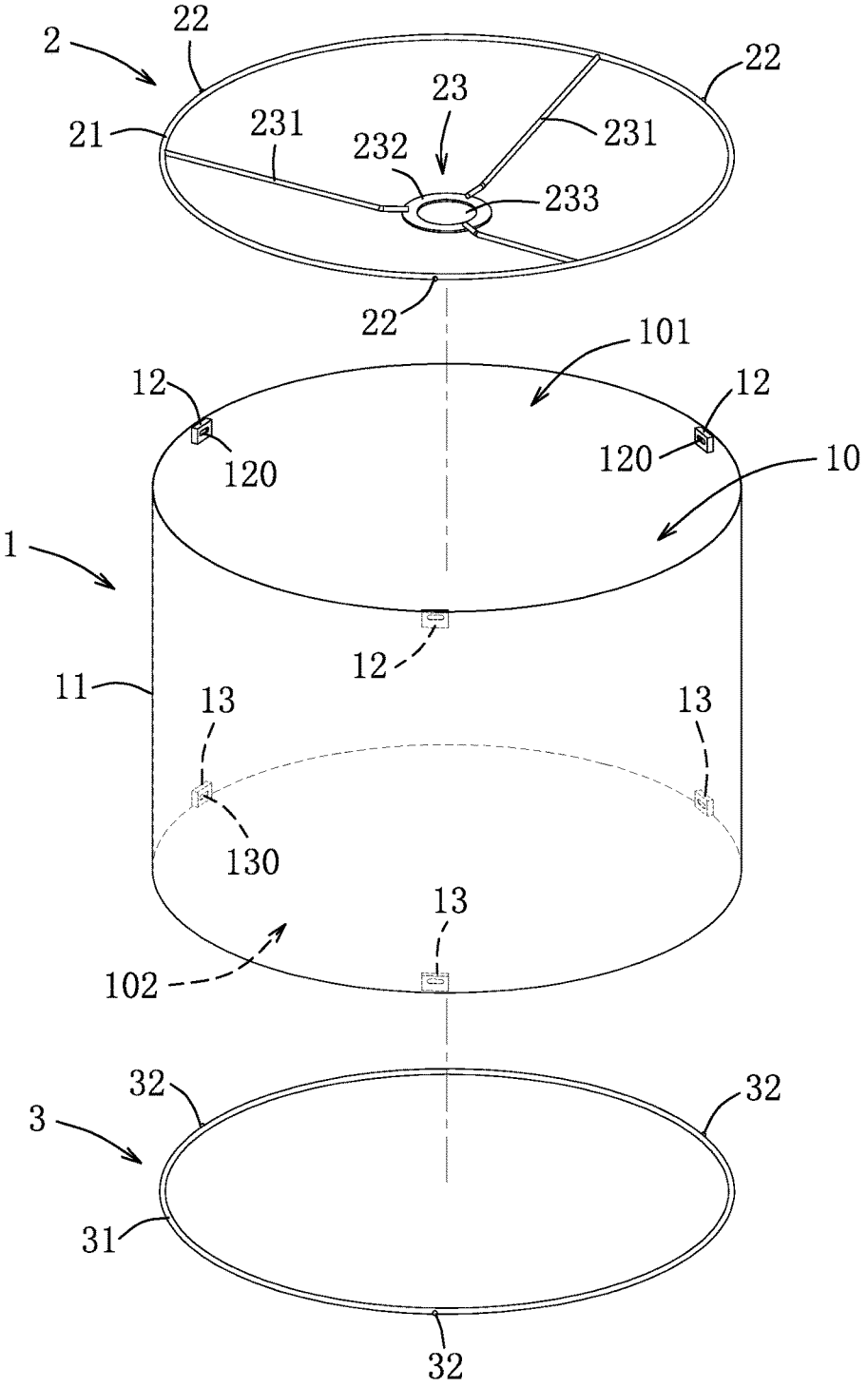
FIG. 1 is an exploded perspective view of an embodiment of a lampshade according to the present disclosure.
Figure 2:
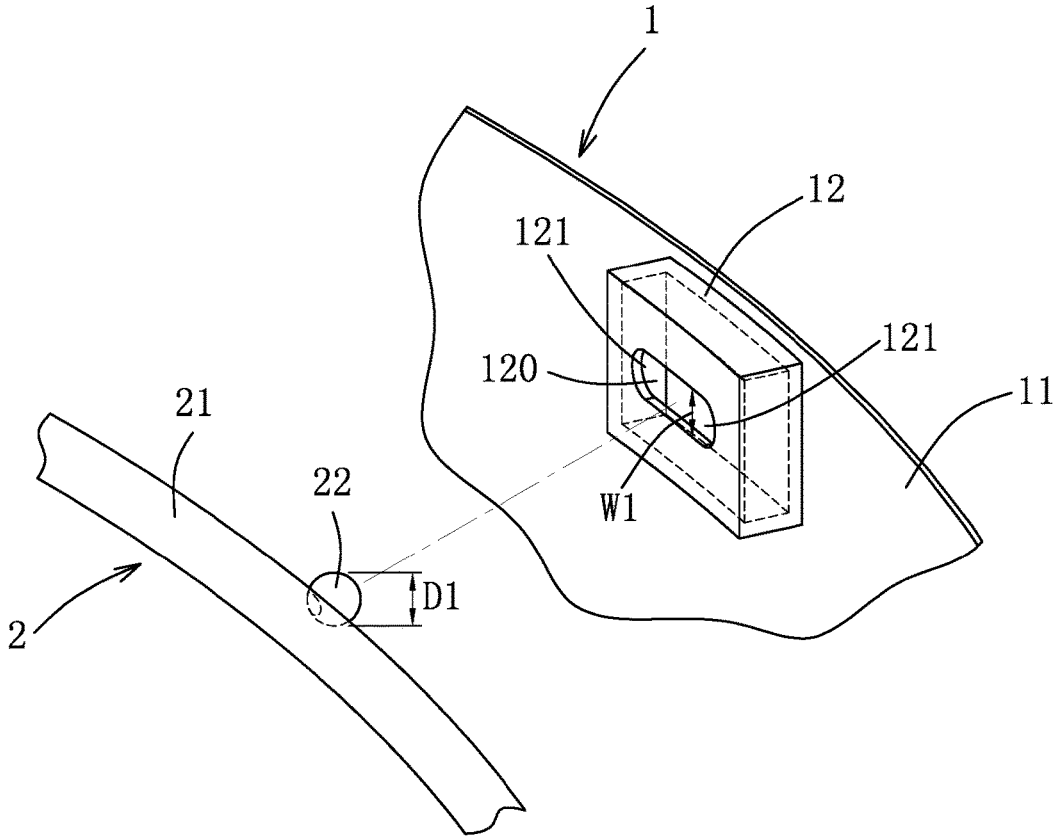
FIG. 2 is a fragmentary exploded perspective view of the embodiment, showing an upper engaging member of a rigid upper frame being aligned with an upper fixing member of a shade unit.
Figure 3:
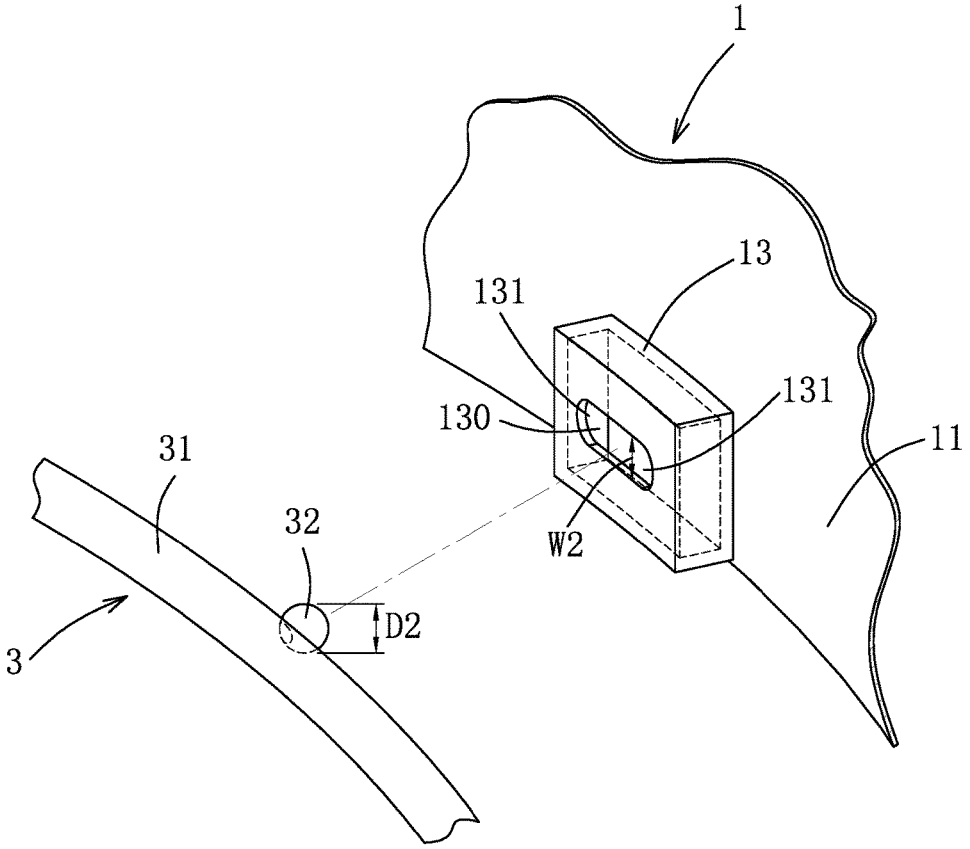
FIG. 3 is a fragmentary exploded perspective view of the embodiment, showing a lower engaging member of a rigid lower frame being aligned with a lower fixing member of a shade unit.
Figure 4:
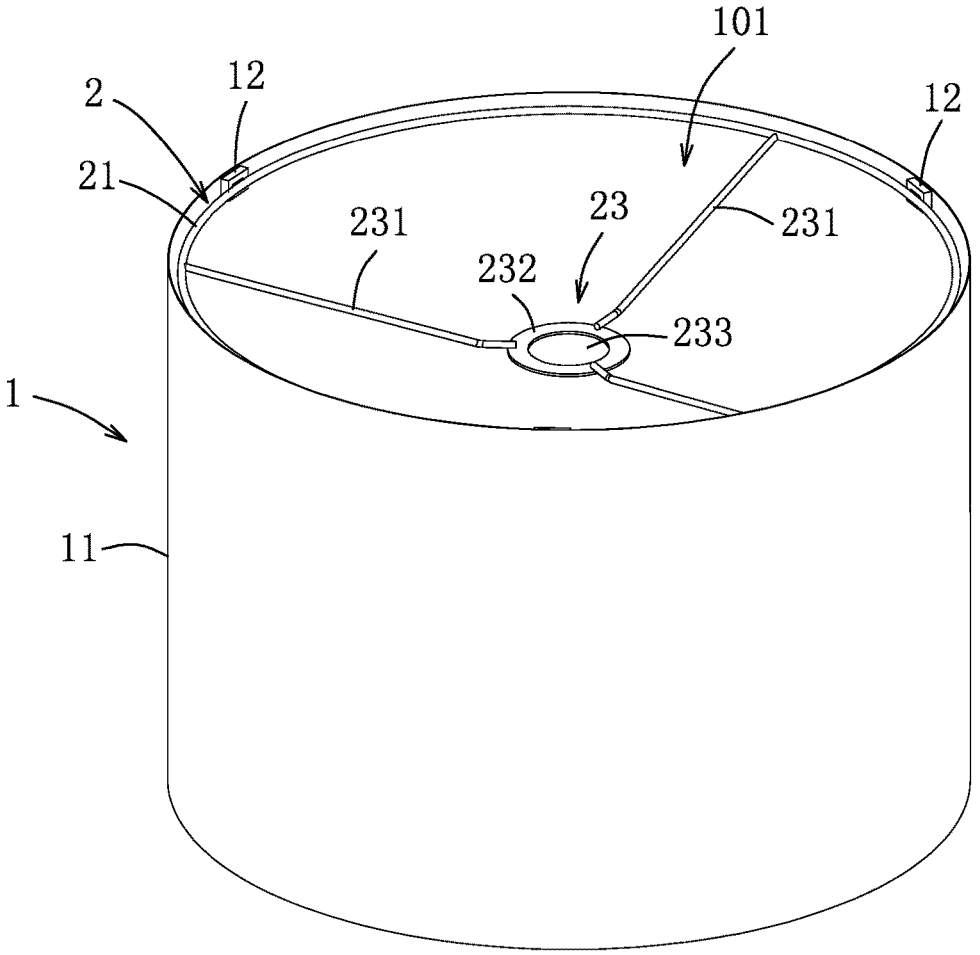
FIG. 4 is a perspective view of the embodiment.
Figure 5:
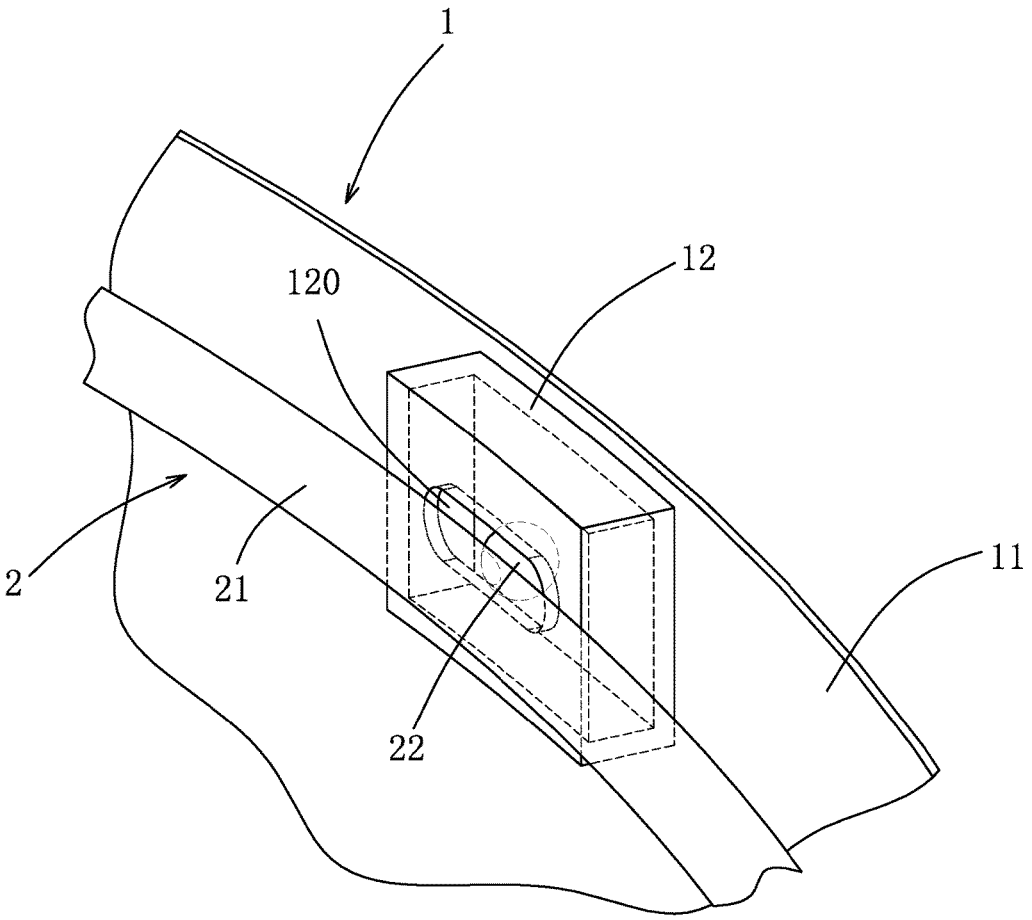
FIG. 5 is a fragmentary schematic view of the embodiment illustrating engagement between the upper engaging member and an upper fixing hole of the upper fixing member.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, an embodiment of a lampshade according to the present disclosure includes a shade unit 1, a rigid upper frame 2 and a rigid lower frame 3. The upper and lower frames 2, 3 are rigid so as to maintain the shape of the shade unit 1.

The shade unit 1 includes a flexible shade body 11, three upper fixing members 12 and three lower fixing members 13. The flexible shade body 11 is light-transmissible, is generally shaped as a hollow cylinder, and defines a receiving space 10 that has an upper opening 101 and a lower opening 102 opposite to the upper opening 101. In this embodiment, each of the upper opening 101 and the lower opening 102 of the receiving space 10 is circular. The upper fixing members 12 are disposed on the flexible shade body 11 and in the receiving space 10, adjacent to the upper opening 101, and spaced apart from each other. The lower fixing members 13 are disposed on the flexible shade body 11 and in the receiving space 10, adjacent to the lower opening 102, and spaced apart from each other. Each of the upper fixing members 12 is formed with an upper fixing hole 120. Each of the lower fixing members 13 is formed with a lower fixing hole 130. In this embodiment, the upper fixing hole 120 of each of the upper fixing members 12 is substantially elongated and has a width (W1), and the lower engaging hole 130 of each of the lower fixing members 13 is substantially elongated and has a width (W2).

The rigid upper frame 2 is detachably connected to the shade unit 1, is disposed in the receiving space 10 and adjacent to the upper opening 101, and includes an upper frame body 21, three upper engaging members 22 and a base 23. In this embodiment, the upper frame body 21 of the rigid upper frame 2 is annular such that the upper frame body 21 of the rigid upper frame 2 fittingly engages the upper opening 101 of the receiving space 10. The upper engaging members 22 project outwardly from the upper frame body 21, are spaced apart from each other, and engage respectively and detachably the upper fixing holes 120 of the upper fixing members 12.

To be more specific, each of the upper fixing members 12 is hollow. The upper fixing hole 120 of each of the upper fixing members 12 has two closed ends 121. Each of the upper engaging members 22 extends through a respective one of the upper fixing holes 120 of the upper fixing members 12, has a portion that is confined within the respective one of the upper fixing members 12, is sized so as not to pass through the respective one of the upper fixing holes 120, and is shaped to allow to be forced manually to pass through the respective one of the upper fixing holes 120.

In this embodiment, each of the upper engaging members 22 of the rigid upper frame 2 is generally spherical and has a maximum diameter (D1) slightly larger than the width (W1) of the upper fixing hole 120 of a respective one of the upper fixing members 12 such that each of the upper engaging members 22 of the rigid upper frame 2 can be fixedly and detachably connected to the respective one of the upper fixing members 12. The base 23 is connected to and projects inwardly from the upper frame body 21, and that is adapted for a lamp unit 4 (see FIG. 6) to be mounted thereon.

In this embodiment, the base 23 of the rigid upper frame 2 includes three connecting rods 231 that are connected to and project inwardly from the upper frame body 21, and an annular base body 232 that interconnects the connecting rods 231 and that has a through hole 233 adapted for the lamp unit 4 to pass therethrough. In this embodiment, the connecting rods 231 of the base 23 are inclined and project downwardly and inwardly from the upper frame body 21.

The rigid lower frame 3 is detachably connected to the shade unit 1, is disposed in the receiving space (10) and adjacent to the lower opening 102, and includes a lower frame body 31 and a three lower engaging members 32. In this embodiment, the lower frame body 31 of the rigid lower frame 3 is annular such that the lower frame body 31 of the rigid lower frame 3 fittingly engages the lower opening 102 of the receiving space 10. The lower engaging members 32 project outwardly from the lower frame body 31, are spaced apart from each other, and engage respectively and detachably the lower fixing holes 130 of the lower fixing members 13.

To be more specific, each of the lower fixing members 13 is hollow. The lower fixing hole 130 of each of the lower fixing members 13 has two closed ends 131. Each of the lower engaging members 32 extends through a respective one of the lower fixing holes 130 of the lower fixing members 13, has a portion that is confined within the respective one of the lower fixing members 13, is sized so as not to pass through the respective one of the lower fixing holes 130, and is shaped to allow to be forced manually to pass through the respective one of the lower fixing holes 130.

In this embodiment, each of the lower engaging members 32 of the rigid lower frame 3 is generally spherical and has a maximum diameter (D2) slightly larger than the width (W2) of the lower fixing hole 130 of a respective one of the lower fixing members 13 such that each of the lower engaging members 32 of the rigid lower frame 3 can be fixedly and detachably connected to the respective one of the lower fixing members 13.

Figure 6:
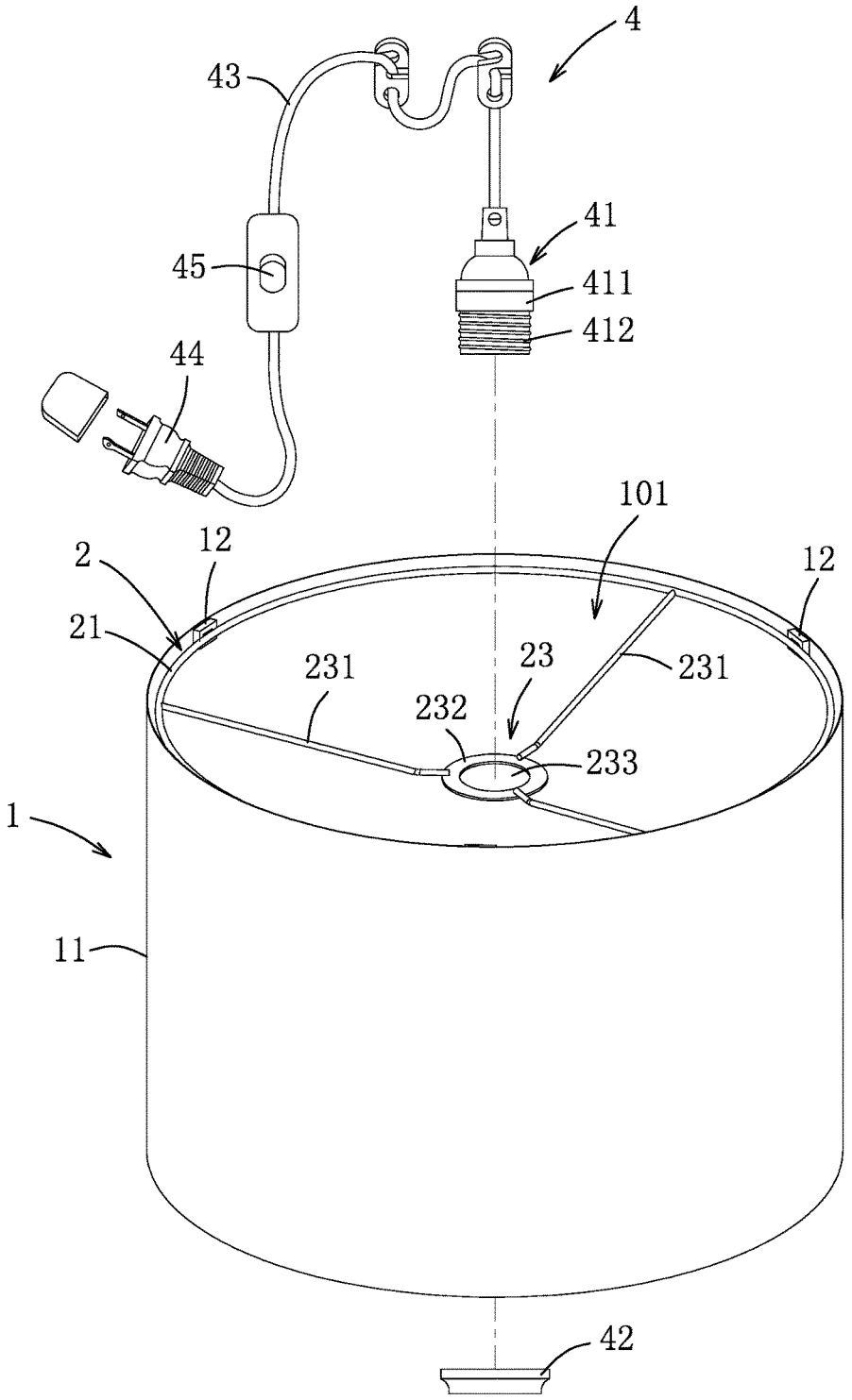
FIG. 6 is a schematic perspective view, showing a lamp unit to be mounted to the embodiment.
Figure 7:
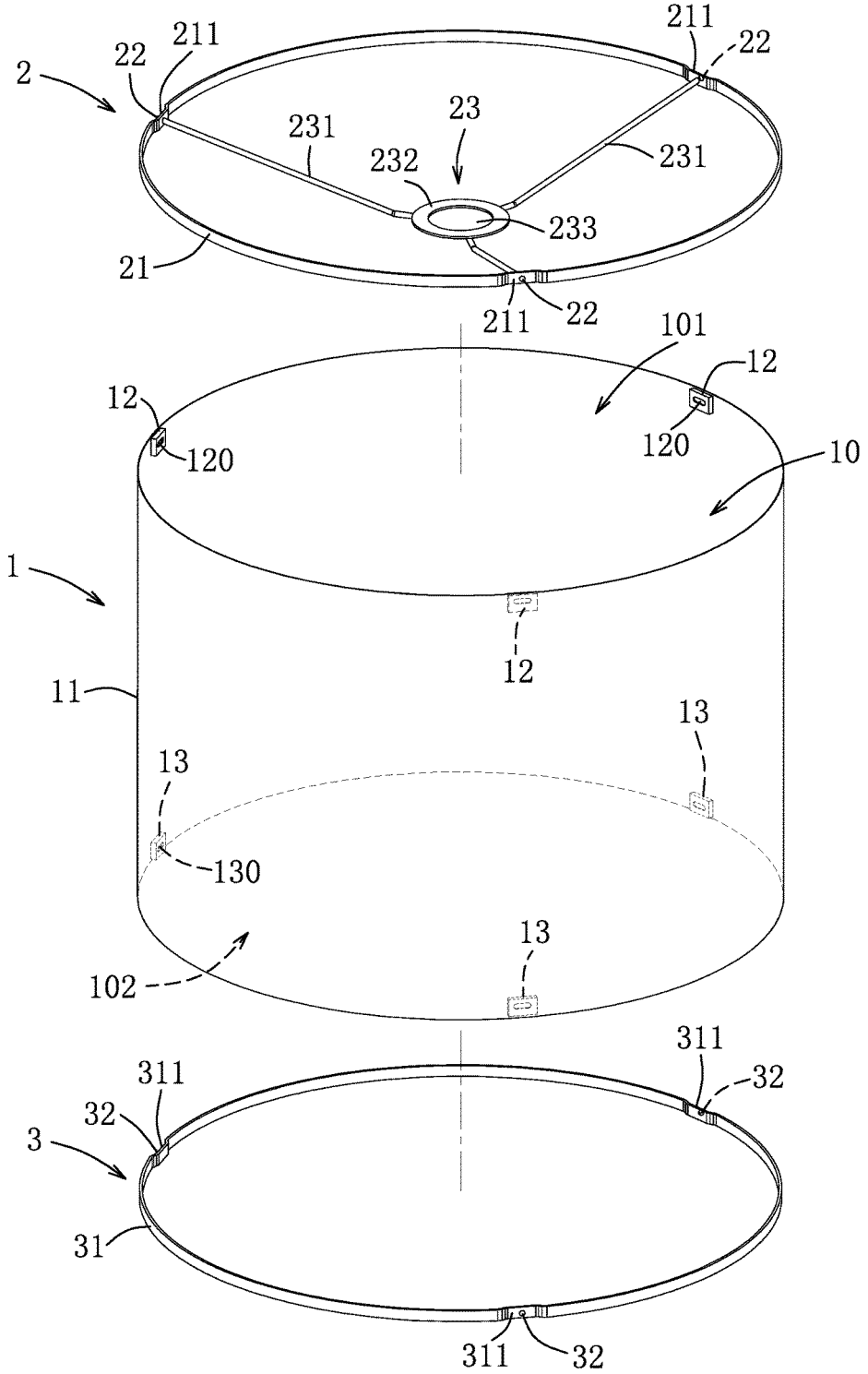
FIG. 7 is an exploded perspective view of a variation of the embodiment.
Figure 8:
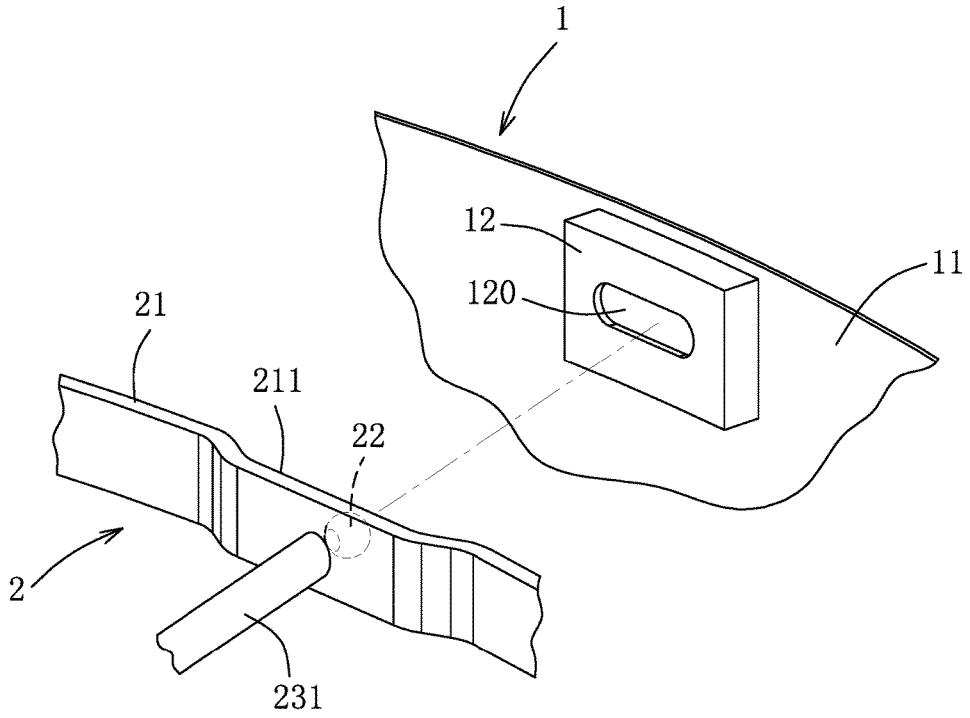
FIG. 8 is a fragmentary exploded perspective view of the variation, showing the upper engaging member of the rigid upper frame being aligned with the upper fixing member of the shade unit.
Figure 9:
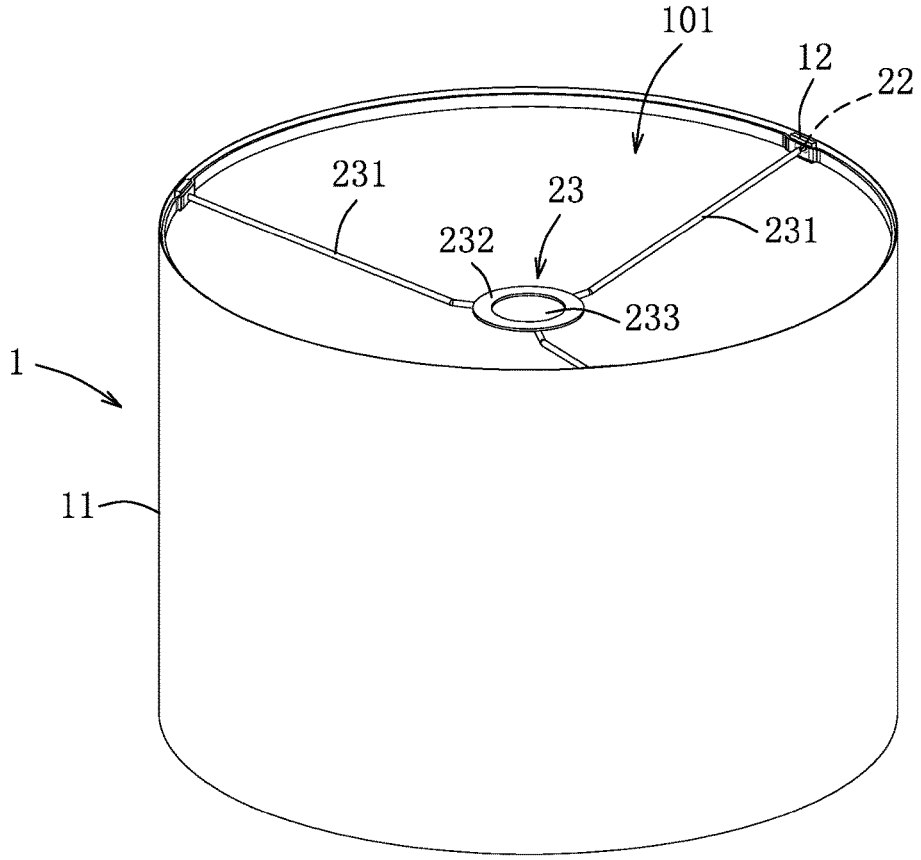
FIG. 9 is a perspective view of the variation.
Figure 10:
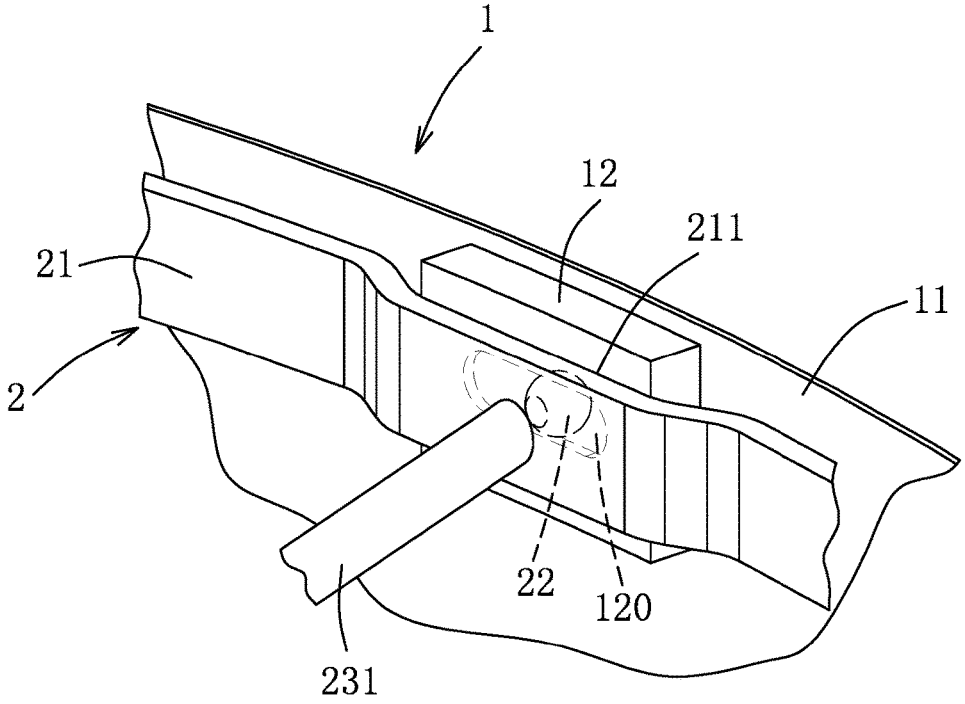
FIG. 10 is an enlarged view of a portion of FIG. 9.

Referring to FIG. 6, the lamp unit 4 can be mounted to the lampshade of this disclosure, and includes a lampholder 41, a fixing member 42, a wire 43, a plug 44 and a switch 45. The lampholder 41 has a lampholder body 411, and a connecting portion 412 that is connected to the lampholder body 411 and that is for a light bulb (not shown) to be mounted thereto. The fixing member 42 is detachably connected to the lampholder 41 so as to detachably mount the lamp unit 4 to the lampshade. The wire 43 interconnects the plug 44 and the lampholder 41. The switch 45 is disposed on the wire 43 and is operable to turn on or off the lamp unit 4. In assembly, the connecting portion 412 of the lampholder 41 extends through the through hole 233 of the base 23 in such a way that the lampholder body 411 of the lampholder 41 abuts against the annular base body 232 of the base 23, followed by moving the fixing member 42 through the lower opening 102 to connect with the connecting portion 412. Then, the light bulb can be mounted to the connecting portion 412 via the lower opening 102.

FIGS. 7 to 10 show a variation of the embodiment of the lampshade. In the variation, each of the upper frame body 21 of the rigid upper frame 2 and the lower frame body 31 of the rigid lower frame 3 is an annular flat band. The upper frame body 21 has three upper recesses 211 that are inwardly indented from an outer peripheral surface of the upper frame body 21. Each of the upper engaging members 22 is located in a respective one of the upper recesses 211. Each of the upper fixing members 12 of the shade unit 1 engages a respective one of the upper recesses 211, such that a wall of the upper frame body 21 defining the respective one of the upper recesses 211 abuts against a respective one of the upper fixing members 12. The lower frame body 31 has three lower recesses 311 that are inwardly indented from an outer peripheral surface of the lower frame body 31. Each of the lower engaging members 32 is located in a respective one of the lower recesses 311. Each of the lower fixing members 13 of the shade unit 1 engages a respective one of the lower recesses 311 of the lower frame body 31, such that a wall of the lower frame body 31 defining the respective one of the lower recesses 311 abuts against a respective one of the lower fixing members 13.

In summary, since the upper and lower fixing holes 120, 130 are capable of engaging the upper and lower engaging members 22, 32 of the lampshade according to this disclosure, an user can assemble or dissemble the lampshade without using a tool such as a screw driver. The shade unit 1 dissembled from the lampshade can be collapsed and folded, which not only is convenient to transport but also is less likely to be damaged during transport.

In the description above, for the purposes of explanation, numerous specific details have been set forth in order to provide a thorough understanding of the embodiment and variation. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiment and variation, it is understood that this disclosure is not limited to the disclosed embodiment and variation but is intended to cover various arrangements included within the spirit and scope of the broadest interpretation so as to encompass all such modifications and equivalent arrangements.

What is claimed is:

1. A lampshade comprising:

a shade unit including a flexible shade body that defines a receiving space having an upper opening and a lower opening opposite to said upper opening, a plurality of upper fixing members that are disposed on said flexible shade body and in said receiving space and adjacent to said upper opening, each of said upper fixing members being formed with an upper fixing hole, and a plurality of lower fixing members that are disposed on said flexible shade body and in said receiving space and adjacent to said lower opening, each of said lower fixing members being formed with a lower fixing hole;

a rigid upper frame that is disposed in said receiving space and adjacent to said upper opening, said rigid upper frame including an upper frame body, a plurality of upper engaging members that project outwardly from said upper frame body and engage respectively and detachably said upper fixing holes of said upper fixing members, and a base that is connected to and projects inwardly from said upper frame body and that is adapted for a lamp unit to be mounted thereon; and a rigid lower frame that is disposed in said receiving space and adjacent to said lower opening, said rigid lower frame including a lower frame body, and a plurality of lower engaging members that project outwardly from said lower frame body and engage respectively and detachably said lower engaging holes of said lower fixing members.

2. The lampshade as claimed in claim 1, wherein:

said shade unit includes three of said upper fixing members that are spaced apart from each other, and three of said lower fixing members that are spaced apart from each other;

said rigid upper frame includes three of said upper engaging members that respectively and detachably engage said upper fixing holes of said upper fixing members; and said rigid lower frame includes three of said lower engaging members that respectively and detachably engage said lower engaging holes of said lower fixing members.

3. The lampshade as claimed in claim 1, wherein:

said upper fixing hole of each of said upper fixing members is substantially elongated and has a width;

said lower engaging hole of each of said lower fixing members is substantially elongated and has a width;

each of said upper engaging members of said rigid upper frame is generally spherical and has a maximum diameter larger than said width of said upper fixing hole of a respective one of said upper fixing members; and each of said lower engaging members of said rigid lower frame is generally spherical and has a maximum diameter larger than said width of said lower engaging hole of a respective one of said lower fixing members.

4. The lampshade as claimed in claim 1, wherein:

each of said upper opening and said lower opening of said receiving space is circular;

said upper frame body of said rigid upper frame is annular; and said lower frame body of said rigid lower frame is annular.

5. The lampshade as claimed in claim 4, wherein:

said upper frame body of said rigid upper frame fittingly engages said upper opening of said receiving space; and said lower frame body of said rigid lower frame fittingly engages said lower opening of said receiving space.

6. The lampshade as claimed in claim 1, wherein said flexible shade body of said shade unit is light-transmissible.

7. The lampshade as claimed in claim 1, wherein said base of said rigid upper frame includes three connecting rods that are connected to and project inwardly from said upper frame body, and an annular base body that interconnects said connecting rods and that has a through hole adapted for the lamp unit to pass therethrough.

8. The lampshade as claimed in claim 7, wherein said connecting rods of said base are inclined and project downwardly and inwardly from said upper frame body.

9. The lampshade as claimed in claim 1, wherein each of said upper frame body of said rigid upper frame and said lower frame body of said rigid lower frame is an annular flat band.

10. The lampshade as claimed in claim 9, wherein:

said upper frame body has a plurality of upper recesses that are inwardly indented from an outer peripheral surface of said upper frame body;

each of said upper engaging members is located in a respective one of said upper recesses;

said lower frame body has a plurality of lower recesses that are inwardly indented from an outer peripheral surface of said lower frame body; and each of said lower engaging members is located in a respective one of said lower recesses.

11. The lampshade as claimed in claim 10, wherein:

each of said upper fixing members of said shade unit engages a respective one of said upper recesses of said upper frame body, such that a wall of said upper frame body defining the respective one of said upper recesses abuts against a respective one of said upper fixing members; and each of said lower fixing members of said shade unit engages a respective one of said lower recesses of said lower frame body, such that a wall of said lower frame body defining the respective one of said lower recesses abuts against a respective one of said lower fixing members.

12. The lampshade as claimed in claim 1, wherein:

each of said upper engaging members extends through a respective one of said upper fixing holes, has a portion that is confined within the respective one of said upper fixing members, is sized so as not to pass through the respective one of said upper fixing holes, and is shaped to allow to be forced manually to pass through the respective one of said upper fixing holes; and each of said lower engaging members extends through a respective one of said lower engaging holes, has a portion that is confined within the respective one of said lower fixing members, is sized so as not to pass through the respective one of said lower engaging holes, and is shaped to allow to be forced manually to pass through the respective one of said lower engaging holes.

13. The lampshade as claimed in claim 1, wherein each of said upper fixing members is hollow, said upper fixing hole of each of said upper fixing members having two closed ends, each of said lower fixing members being hollow, said lower fixing hole of each of said lower fixing members having two closed ends.

* * * * *